US012637251B2

(12) United States Patent
Waddington

(10) Patent No.: US 12,637,251 B2
(45) Date of Patent: May 26, 2026

(54) CARTON WITH OPENING FEATURES

(71) Applicant: Graphic Packaging International, LLC, Atlanta, GA (US)

(72) Inventor: Paul Waddington, Castleford (GB)

(73) Assignee: Graphic Packaging International, LLC, Atlanta, GA (US)

( * ) Notice: Subject to any disclaimer, the term of this patent is extended or adjusted under 35 U.S.C. 154(b) by 40 days.

(21) Appl. No.: 18/127,305

(22) Filed: Mar. 28, 2023

(65) Prior Publication Data

US 2023/0312166 A1 Oct. 5, 2023

Related U.S. Application Data

(60) Provisional application No. 63/324,900, filed on Mar. 29, 2022.

(51) Int. Cl.

| | |
|---|---|
| ***B65D 5/72*** | (2006.01) |
| ***B65D 5/02*** | (2006.01) |
| ***B65D 55/02*** | (2006.01) |

(52) U.S. Cl.

CPC ..... *B65D 5/721* (2013.01); *B65D 5/0227* (2013.01); *B65D 55/02* (2013.01)

(58) Field of Classification Search

CPC ..... B65D 5/721; B65D 5/72

See application file for complete search history.

(56) References Cited

U.S. PATENT DOCUMENTS

| | | | |
|---|---|---|---|
| 83,812 | A | 11/1868 | Wilcox |
| 362,583 | A | 5/1887 | Jordan |
| 567,649 | A | 9/1896 | Lanzit |
| 1,082,868 | A | 12/1913 | Hollett |
| 1,772,625 | A | 8/1930 | Caulfield |
| 2,192,722 | A | 3/1940 | Vogt |
| 2,355,665 | A | 8/1944 | Mabee |
| 2,475,677 | A | 7/1949 | Ringler |

(Continued)

FOREIGN PATENT DOCUMENTS

| | | |
|---|---|---|
| DE | 28 06 308 A1 | 8/1978 |
| DE | 29 23 455 | 12/1980 |

(Continued)

OTHER PUBLICATIONS

International Search Report and Written Opinion for PCT/US2023/016542 dated Jul. 12, 2023.

(Continued)

*Primary Examiner* — Nathan J Newhouse
*Assistant Examiner* — Nina K Attel
(74) *Attorney, Agent, or Firm* — Andrew N. Claerbout; FisherBroyles, LLP

(57) ABSTRACT

A carton for holding at least one article includes a plurality of panels extending at least partially around an interior of the carton, the plurality of panels including a plurality of side panels, a plurality of end flaps foldably connected to a respective side panel of the plurality of side panels, the plurality of end flaps forming a reclosable end of the carton, the plurality of end flaps including at least one top end flap having a plurality of reconfigurable portions, and opening features for transitioning the reclosable end of the carton from a closed configuration to an open configuration when pressed by a user.

33 Claims, 4 Drawing Sheets

(56) References Cited

U.S. PATENT DOCUMENTS

| | | | | | |
|---|---|---|---|---|---|
| 2,509,289 | A | | 5/1950 | Dunning | |
| 2,654,525 | A | * | 10/1953 | Adorney | B65D 5/541 229/215 |
| 2,757,851 | A | | 8/1956 | Moore | |
| 3,016,181 | A | * | 1/1962 | Desmond | B65D 5/061 229/139 |
| 3,107,839 | A | * | 10/1963 | Kauffeld | B65D 5/745 229/125.17 |
| 3,133,688 | A | | 5/1964 | Asman | |
| 3,300,115 | A | | 1/1967 | Schauer | |
| 3,355,089 | A | | 11/1967 | Champlin | |
| 3,363,822 | A | | 1/1968 | Maulini et al. | |
| 3,426,955 | A | | 2/1969 | Olson | |
| 3,529,763 | A | | 9/1970 | Wagner | |
| 3,581,977 | A | | 6/1971 | Kirsky et al. | |
| 3,669,345 | A | | 6/1972 | Cote | |
| 3,680,766 | A | | 8/1972 | Collura et al. | |
| 3,690,544 | A | | 9/1972 | Meyers | |
| 3,768,719 | A | | 10/1973 | Johnson | |
| 3,971,503 | A | | 7/1976 | Allan | |
| 4,191,324 | A | | 3/1980 | Kitagawa | |
| 4,252,267 | A | | 2/1981 | Osborne | |
| 4,272,009 | A | | 6/1981 | Bamburg | |
| 4,313,553 | A | | 2/1982 | Lisiecki | |
| 4,344,537 | A | | 8/1982 | Austin | |
| 4,508,218 | A | | 4/1985 | Focke et al. | |
| 4,558,785 | A | | 12/1985 | Gordon | |
| 4,645,108 | A | | 2/1987 | Gavin et al. | |
| 4,676,394 | A | | 6/1987 | Hiersteiner | |
| 4,712,727 | A | | 12/1987 | Wyberg | |
| 4,762,234 | A | | 8/1988 | Wyberg | |
| 4,848,589 | A | | 7/1989 | Olson | |
| 4,905,898 | A | | 3/1990 | Wade | |
| 5,020,337 | A | | 6/1991 | Krieg | |
| 5,255,494 | A | | 10/1993 | Doyle | |
| 5,292,058 | A | | 3/1994 | Zoss et al. | |
| 5,326,024 | A | | 7/1994 | Fogle | |
| 5,335,847 | A | | 8/1994 | Lisiecki | |
| 5,347,865 | A | | 9/1994 | Mulry et al. | |
| 5,501,394 | A | | 3/1996 | Eno | |
| 5,632,402 | A | | 5/1997 | Walsh et al. | |
| 5,632,404 | A | | 5/1997 | Walsh | |
| 5,746,871 | A | | 5/1998 | Walsh | |
| 5,783,030 | A | | 7/1998 | Walsh | |
| 5,794,811 | A | | 8/1998 | Walsh | |
| 5,794,812 | A | | 8/1998 | Walsh | |
| 5,816,487 | A | | 10/1998 | Skinner | |
| 5,857,614 | A | | 1/1999 | Walsh | |
| 5,918,799 | A | | 7/1999 | Walsh | |
| 5,988,494 | A | | 11/1999 | Fontaine | |
| 5,996,882 | A | | 12/1999 | Randall | |
| 6,050,484 | A | | 4/2000 | Galomb | |
| 6,062,467 | A | | 5/2000 | Ours et al. | |
| 6,102,277 | A | | 8/2000 | Krapohl, Sr. | |
| 6,145,736 | A | | 11/2000 | Ours et al. | |
| 6,164,821 | A | | 12/2000 | Randall | |
| 6,206,279 | B1 | | 3/2001 | Countee | |
| 6,352,096 | B1 | | 3/2002 | Walsh | |
| 6,364,202 | B1 | | 4/2002 | Zelley | |
| 6,419,151 | B1 | | 7/2002 | Urtubey | |
| 6,854,639 | B2 | | 2/2005 | Walsh | |
| 6,913,189 | B2 | | 7/2005 | Oliff | |
| 6,929,172 | B2 | | 8/2005 | Bates et al. | |
| 7,025,504 | B2 | | 4/2006 | Olin | |
| 7,036,714 | B2 | | 5/2006 | Walsh et al. | |
| 7,210,612 | B2 | | 5/2007 | Walsh et al. | |
| 7,331,509 | B2 | | 2/2008 | Bates et al. | |
| 7,611,042 | B2 | | 11/2009 | Bates | |
| 7,617,969 | B2 | | 11/2009 | Oliveira | |
| 7,913,897 | B2 | | 3/2011 | Manaige | |
| 8,672,214 | B2 | | 3/2014 | Manaige | |
| 8,770,469 | B2 | | 7/2014 | Burke et al. | |
| 9,169,037 | B2 | | 10/2015 | Pinkstone | |
| 9,346,582 | B2 | | 5/2016 | Pinkstone | |
| 9,758,275 | B2 | | 9/2017 | Fitzwater | |
| 9,771,176 | B2 | | 9/2017 | Kastanek | |
| 9,809,373 | B2 | | 11/2017 | Gallimore | |
| 10,023,350 | B2 | | 7/2018 | Faulkner | |
| 10,173,805 | B2 | | 1/2019 | Waddington | |
| 10,232,976 | B2 | | 3/2019 | Waddington | |
| 10,472,120 | B2 | | 11/2019 | Cooper et al. | |
| D999,055 | S | | 9/2023 | Waddington | |
| 2001/0002677 | A1 | | 6/2001 | Grabher | |
| 2001/0048022 | A1 | | 12/2001 | Zoeckler | |
| 2002/0055429 | A1 | | 5/2002 | Walsh | |
| 2003/0144121 | A1 | | 7/2003 | Walsh et al. | |
| 2004/0102748 | A1 | | 5/2004 | Hirotsu | |
| 2004/0112948 | A1 | | 6/2004 | Bone | |
| 2004/0226989 | A1 | | 11/2004 | Cook et al. | |
| 2005/0127150 | A1 | | 6/2005 | Walsh et al. | |
| 2005/0187087 | A1 | | 8/2005 | Walsh | |
| 2005/0199695 | A1 | | 9/2005 | DeBusk et al. | |
| 2005/0209576 | A1 | | 9/2005 | Hirotsu | |
| 2005/0274782 | A1 | | 12/2005 | Petrelli et al. | |
| 2006/0054675 | A1 | | 3/2006 | Bennett | |
| 2006/0243783 | A1 | | 11/2006 | Spivey, Sr. et al. | |
| 2006/0255107 | A1 | | 11/2006 | Wright | |
| 2007/0194093 | A1 | | 8/2007 | Ford | |
| 2008/0296360 | A1 | | 12/2008 | Abel et al. | |
| 2015/0368019 | A1 | | 12/2015 | Pinkstone | |
| 2017/0113832 | A1 | | 4/2017 | Faulkner | |
| 2017/0225822 | A1 | | 8/2017 | Cooper et al. | |

FOREIGN PATENT DOCUMENTS

| | | | | | |
|---|---|---|---|---|---|
| DE | 81 10 323.9 | | | 9/1981 | |
| DE | 87 08 078.8 | | | 10/1987 | |
| DE | 94 13 813 | | | 10/1994 | |
| EP | 1 457 425 | | | 9/2004 | |
| FR | 2 699 150 | | | 6/1994 | |
| FR | 2 755 670 | | | 5/1998 | |
| GB | 104445 | | | 3/1917 | |
| GB | 1 242 356 | | | 8/1971 | |
| GB | 1 489 963 | | | 10/1977 | |
| GB | 1 584 066 | | | 2/1981 | |
| GB | 2 363 372 | | | 12/2001 | |
| GB | 2600502 | A | * | 5/2022 | B65D 27/34 |
| JP | 2009-137596 | A | | 6/2009 | |
| JP | 2010-013141 | A | | 1/2010 | |
| JP | 2016-537264 | A | | 12/2016 | |
| KR | 20-1998-0019535 | | | 7/1998 | |
| KR | 10-0211329 | | | 8/1999 | |
| KR | 10-0354924 | | | 10/2002 | |
| KR | 10-2004-0004669 | | | 1/2004 | |
| KR | 10-2005-0013599 | | | 2/2005 | |
| KR | 10-2016-0058413 | | | 5/2016 | |
| WO | WO 95/28325 | | | 10/1995 | |
| WO | WO 2006/124643 | | | 11/2006 | |
| WO | WO 2006/133401 | | | 12/2006 | |
| WO | WO 2007/050722 | A1 | | 5/2007 | |
| WO | WO 2009/103311 | A1 | | 8/2009 | |
| WO | WO 2014/206939 | A1 | | 12/2014 | |
| WO | WO-2021073599 | A1 | * | 4/2021 | B65D 3/08 |

OTHER PUBLICATIONS

Extended European Search Report issued in App. No. EP23781678, dated Feb. 5, 2026 (pp. 1-8).

* cited by examiner

CARTON WITH OPENING FEATURES

CROSS-REFERENCE TO RELATED APPLICATION

This application claims the benefit of U.S. Provisional Patent Application No. 63/324,900, filed on Mar. 29, 2022.

INCORPORATION BY REFERENCE

The disclosure of U.S. Provisional Patent Application No. 63/324,900, filed on Mar. 29, 2022, is hereby incorporated by reference for all purposes as if presented herein in its entirety.

BACKGROUND

The present disclosure generally relates to cartons for holding and dispensing articles.

SUMMARY

According to one aspect, the disclosure is generally directed to carton for holding at least one article, the carton comprising a plurality of panels extending at least partially around an interior of the carton, the plurality of panels comprising a plurality of side panels, a plurality of end flaps foldably connected to a respective side panel of the plurality of side panels, the plurality of end flaps forming a reclosable end of the carton, the plurality of end flaps comprising at least one top end flap having a plurality of reconfigurable portions, and opening features for transitioning the reclosable end of the carton from a closed configuration to an open configuration when pressed by a user.

According to another aspect, the disclosure is generally directed to a blank for forming a carton for holding at least one article, the blank comprising a plurality of panels for extending at least partially around an interior of the carton formed from the blank, the plurality of panels comprising a plurality of side panels, a plurality of end flaps foldably connected to a respective side panel of the plurality of side panels, the plurality of end flaps for forming a reclosable end of the carton formed from the blank, the plurality of end flaps comprising at least one top end flap having a plurality of reconfigurable portions, and opening features for transitioning the reclosable end of the carton formed from the blank from a closed configuration to an open configuration when the opening features are pressed by a user.

According to another aspect, the disclosure is generally directed to a method of forming a carton for holding at least one article, the method comprising obtaining a blank comprising a plurality of panels, a plurality of end flaps foldably connected to a respective panel of the plurality of panels, and opening features, the plurality of panels comprising a plurality of side panels, the plurality of end flaps comprising at least one top end flap having a plurality of reconfigurable portions. The method further comprises positioning the plurality of panels extending at least partially around an interior of the carton, and forming a reclosable end of the carton from the plurality of end flaps such that the opening features are for transitioning the reclosable end of the carton from a closed configuration to an open configuration when pressed by a user.

Those skilled in the art will appreciate the above-stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

Cartons according to the present disclosure can accommodate articles of numerous different shapes. For the purpose of illustration and not for the purpose of limiting the scope of the disclosure, the following detailed description describes articles such as food products. Such food products can be provided in discrete or granular portions, e.g., as in snacks, for example, candy, gum, chocolate, granola, cereal, nuts, trail mix, raisins, dried fruit, etc. It will be understood that a different type of article such as a different type of food product can be held in cartons according to the present disclosure without departing from the disclosure. It will be further understood that articles other than food products can be held in cartons according to the present disclosure.

In this specification, the terms "lower," "bottom," "upper," and "top" indicate orientations determined in relation to fully erected and upright cartons. As described herein, cartons can be formed from blanks by overlapping multiple panels, portions, and/or end flaps. Such panels, portions and/or end flaps may be designated herein in terms relative to one another, e.g., "first", "second", "third", etc., in sequential or non-sequential reference, without departing from the disclosure.

Figure 1:
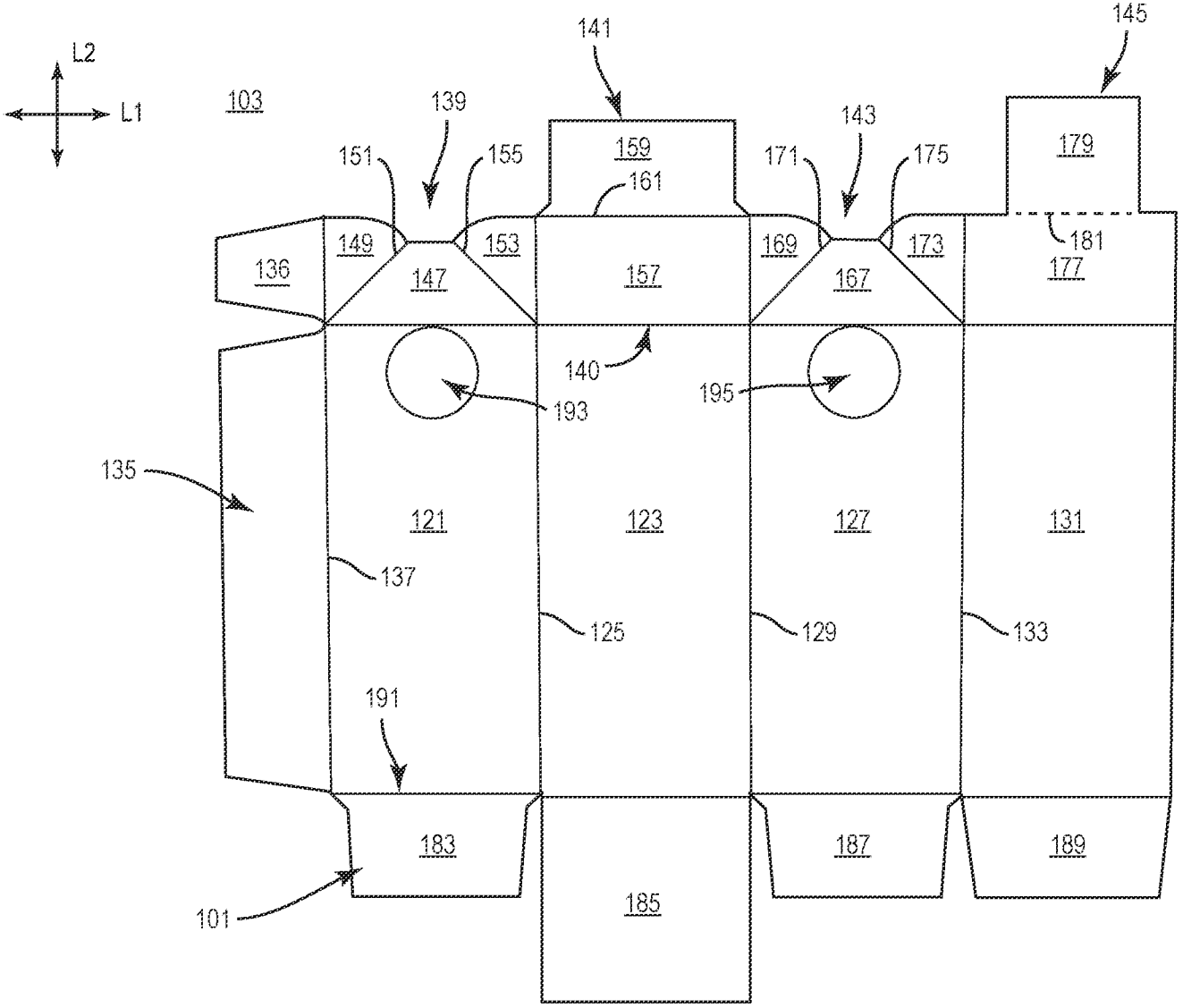
FIG. 1 is a plan view of an exterior surface of a blank used to form a carton according to an exemplary embodiment of the disclosure.

FIG. 1 is a plan view of an exterior surface 101 of a blank, generally indicated at 103, used to form a container or carton 105 (FIG. 2) according to an exemplary embodiment of the disclosure. As described further herein, the carton 105 can be provided with opening features that facilitate reconfiguration of the carton 105 from a closed configuration of the carton 105, in which the at least one reclosable end of the carton 105 restricts access to the interior 107 of the carton 105, to an open configuration of the carton 105, in which at least one reclosable end of the carton 105 provides access to the interior 107 (FIG. 3) of the carton 105.

As shown in FIG. 1, the blank 103 can have a longitudinal axis L1 and a lateral axis L2, and a plurality of panels for extending at least partially around the interior 107 of the carton 105 formed from the blank 103. In the illustrated embodiment, the plurality of panels of the carton 105/blank 103 can include a first side panel 121, a front panel or second side panel 123 foldably connected to the first side panel 121 at a lateral fold line 125, a third side panel 127 foldably connected to the second side panel 123 at a lateral fold line 129, and a back panel or fourth side panel 131 foldably connected to the third side panel 127 at a lateral fold line 133.

An attachment flap or attachment panel 135 can be foldably connected to the first side panel 121 at a lateral fold line 137.

The blank 103 can also include a plurality of end flaps. As described herein, the plurality of end flaps can include a plurality of top end flaps that can be at least partially overlapped to form a reclosable top end 109 of the carton 105, and the plurality of end flaps can include a plurality of bottom end flaps that can be at least partially overlapped to form a closed bottom end 111 of the carton 105.

The end flaps can include a first top end flap 139 foldably connected to the first side panel 121 at a respective portion of a longitudinal fold line 140, a top end flap 141 (broadly, "third top end flap") foldably connected to the second side panel 123 at a respective portion of the longitudinal fold line 140 and foldably connected to a portion of the top end flap 139 at a respective portion of the fold line 125, a top end flap 143 (broadly, "second top end flap") foldably connected to the third side panel 127 at a respective portion of the longitudinal fold line 140 and foldably connected to a portion of the top end flap 141 at a respective portion of the fold line 129, and a fourth top end flap 145 foldably connected to the fourth side panel 131 at a respective portion of the longitudinal fold line 140 and foldably connected to a portion of the top end flap 143 at a respective portion of the fold line 133. In this regard, each end flap of the end flaps 139, 141, 143, 145 can be foldably connected to a respective adjacent end flap.

As also shown, an attachment end flap 136 can be foldably connected to the outer portion 149 of the top end flap 149 at a respective portion of the fold line 137. In some embodiments, the attachment end flap 136 can be considered a portion of the attachment panel 135 that is at least partially separated from a reminder thereof by a discontinuity along a free edge of the blank 103.

The end flaps 136, 139, 141, 143, 145 can be a plurality of top end flaps extending along a first marginal portion of the blank 103 for being at least partially overlapped to form a reclosable first end or top end 109 of the carton 105 formed form the blank 103.

It will be understand that the positioning of the fold line 140 can be changed based on the relative dimensions of the panels 121, 123, 127, 131 to which the end flaps 139, 141, 143, 145 are respectively foldably connected.

The top end flap 139, as shown, can include a plurality of reconfigurable portions that includes a central portion 147 foldably connected to the side panel 121 at the respective portion of the fold line 140, a first outer portion 149 foldably connected to the central portion 147 at an oblique fold line 151, and a second outer portion 153 foldably connected to the central portion 147 at an oblique fold line 155 and to the top end flap 141 at the respective portion of the fold line 125.

As shown in FIG. 1, the top end flap 141 can include a base portion 157 foldably connected to the top end flaps 139, 143 at portions of the respective fold lines 125, 129, and a distal portion 159 foldably connected to the base portion 157 at a longitudinal fold line 161. As shown, the base portion 157 of the top end flap 141 can be foldably connected to the outer portion 153 of the top end flap 139 at the respective portion of the fold line 125.

The top end flap 143, as shown, can include a plurality of reconfigurable portions that includes a central portion 167 foldably connected to the side panel 127 at the respective portion of the fold line 140, a first outer portion 169 foldably connected to the central portion 167 at an oblique fold line 171 and to the base portion 157 of the top end flap 141 at a respective portion of the fold line 129, and a second outer portion 173 foldably connected to the central portion 167 at an oblique fold line 175 and to the top end flap 145 at the respective portion of the fold line 133.

With continued reference to FIG. 1, the top end flap 145 can include a base portion 177 foldably connected to the side panel 131 at a respective portion of the fold line 140 and to the outer portion 173 of the top end flap 143 at a respective portion of the fold line 133, and a distal portion 179 foldably connected to the base portion 177 at a longitudinal fold line 181. As described further herein, the distal portion 179 can be an access tab or tamper evident feature of the carton 105 formed from the blank 103.

Still referring to FIG. 1, the plurality of end flaps can include a bottom end flap 183 foldably connected to the first side panel 121 at a respective portion of a longitudinal fold line 191, a bottom end flap 185 foldably connected to the second side panel 123 at a respective portion of the fold line 191, a bottom end flap 187 foldably connected to the third side panel 127 at a respective portion of the fold line 191, and a bottom end flap 189 foldably connected to the fourth side panel 131 at a respective portion of the fold line 191.

The end flaps 183, 185, 187, 189 can be a plurality of bottom end flaps extending along a second marginal portion of the blank 103 for being at least partially overlapped to form closed second end 111 of the carton 105 formed form the blank 103.

The blank 103 also includes opening features for facilitating reconfiguration of the carton 105 from a closed configuration of the carton 105 in which the end 109 of the carton 105 restricts access to the interior 107 of the carton 105, to an open configuration of the carton 105, in which the end 109 provides access to the interior 107 of the carton 105. As described herein, such reconfiguration of the carton 105 from the closed configuration to the open configuration can occur upon pressing by a user.

As described further herein, the opening features can comprise at least one user engagement region 193, 195 (broadly, respective "first user engagement region" and "second user engagement region") at least partially positioned along an upper portion of a respective side panel 121, 127 proximate respective portions of the fold line 140. In the illustrated embodiment, the user engagement regions 193, 195 can be indicated by visual and/or tactile indicia, e.g., a printed circular or ovoid or thumbprint-shaped region and/or a distinctive surface pattern along the exterior surface 101 of the blank 103 and the carton 105 formed therefrom. In other embodiments, one or both of the user engagement regions 193, 195 can be devoid of visual and/or tactile indicia.

Figure 2:
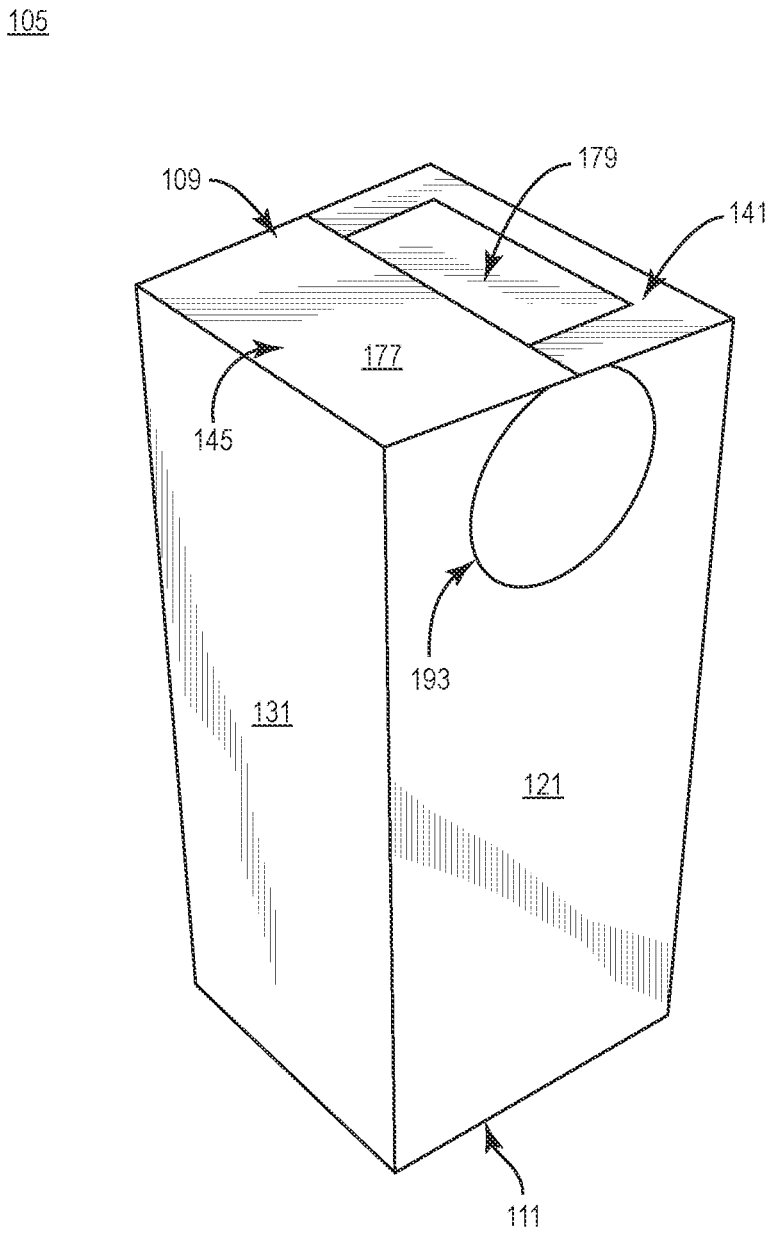
FIG. 2 is a perspective view of a carton formed from the blank of FIG. 1 in a closed configuration according to an exemplary embodiment of the disclosure.

Referring additionally to FIG. 2, formation of the carton 105 from the blank 103 will be described according to an exemplary embodiment of the disclosure. The blank 103 can be positioned with the exterior surface 101 thereof in contact with a supporting surface, e.g., in a face-down orientation, and with an interior surface facing upwardly. The distal portion 159 of the top end flap 141 can be folded at the fold line 161 into at least partial face-to-face contact with the base portion 157 of the top end flap 141 thereof along the interior surface of the blank 103.

The panels 121, 123, 127, 131 can be folded at the fold lines 125, 129, 133 at least partially around the interior 107 of the carton 105 and to position the first side panel 121 and the third side panel 127 in generally spaced and parallel relation, and to position the second side panel 123 and the fourth side panel 131 in generally spaced and parallel relation. In this regard, the first side panel 121 is positioned opposite the third side panel 127, and the second side panel 123 is positioned opposite the fourth side panel 131.

The attachment flap 135 can be folded at the fold line 137 and positioned in at least partial face-to-face contact with an interior surface of the fourth side panel 131. Furthermore, the attachment end flap 136 can be folded at a respective portion of the fold line 137 and positioned in at least partial face-to-face contact with a respective portion of the interior surface of the bae portion 177 of the top end flap 145.

The end flaps 183, 185, 187, 189 can be folded at respective portions of the fold line 191 into at least partial overlapping relation to form the closed second end 111 of the carton 105.

The aforementioned arrangement of the carton 105 can be maintained with one or more applications of an adhesive such as glue. For example, in some embodiments, one or more applications of an adhesive such as glue can be applied to the exterior surface 101 of the blank 103/carton 105 along respective portions of the attachment flap 135, the attachment end flap 136, the distal portion 159 of the top end flap 141, and the bottom end flap 189. In some embodiments, one or more applications of an adhesive such as glue can be applied to the interior surface of the blank 103 along the distal portion 159 of the top end flap 141.

To close the first end 109 of the carton 105, the top end flaps 139, 143 can be folded at respective portions of the fold line 140 toward the interior 107 of the carton 105. Simultaneously or thereafter, the top end flaps 141, 145 can be folded downwardly at respective portions of the fold line 140 toward the interior 107 of the carton 105.

As the top end flaps 139, 143 fold downwardly, the respective portions 147, 149, 153 of the top end flap 139 and the respective portions 167, 169, 173 of the top 143 can reconfigure relative to one another, e.g., at the respective fold lines 151, 155, 171, 175, 140, 135, 137, 129, 133, so as to form a folded/gusseted engagement overlying the interior 107 of the carton 105.

For example, the central portion 147 of the top end flap 139 can fold downwardly at the respective portion of the fold line 140 toward the interior 107 of the carton 105, with the outer portions 149, 153 of the top end flap 139 folding at least partially away from the interior 107 of the carton 105 at the respective fold lines 151, 155. In some embodiments, one or both of the outer portions 149, 153 of the top end flap 139 can be positioned in at least partial face-to-face contact with the central portion 147 of the top end flap 139.

Similarly, the central portion 167 of the top end flap 143 can fold downwardly at the respective portion of the fold line 140 toward the interior 107 of the carton 105, with the outer portions 169, 173 of the top end flap 143 folding at least partially away from the interior 107 of the carton 105 at the respective fold lines 171, 175. In some embodiments, one or both of the outer portions 169, 173 of the top end flap 143 can be positioned in at least partial face-to-face contact with the central portion 167 of the top end flap 143.

Such movement of the top end flaps 139, 143 can cause the top end flaps 141, 145 that are at least partially foldably connected thereto at respective portions of the fold lines 125, 129, 133 to fold downwardly at the respective portions of the fold line 140 over the top end flaps 139, 143, such that the base portion 157 of the top end flap 141 and the base portion 177 of the top end flap 145 are exposed on the exterior of the closed end 109 of the carton 105. In some embodiments, the distal portion 179 of the top end flap 145 can be adhered to the base portion 157 of the top end flap 141.

In the aforementioned closed arrangement of the carton 105, at least the top end flaps 141, 145 can be positioned in generally planar relation with one another and in generally perpendicular relation with the plurality of panels 121, 123, 127, 131, 135, and the top end flaps 139, 143 can be positioned in the interior 107 of the carton 105.

Figure 3:
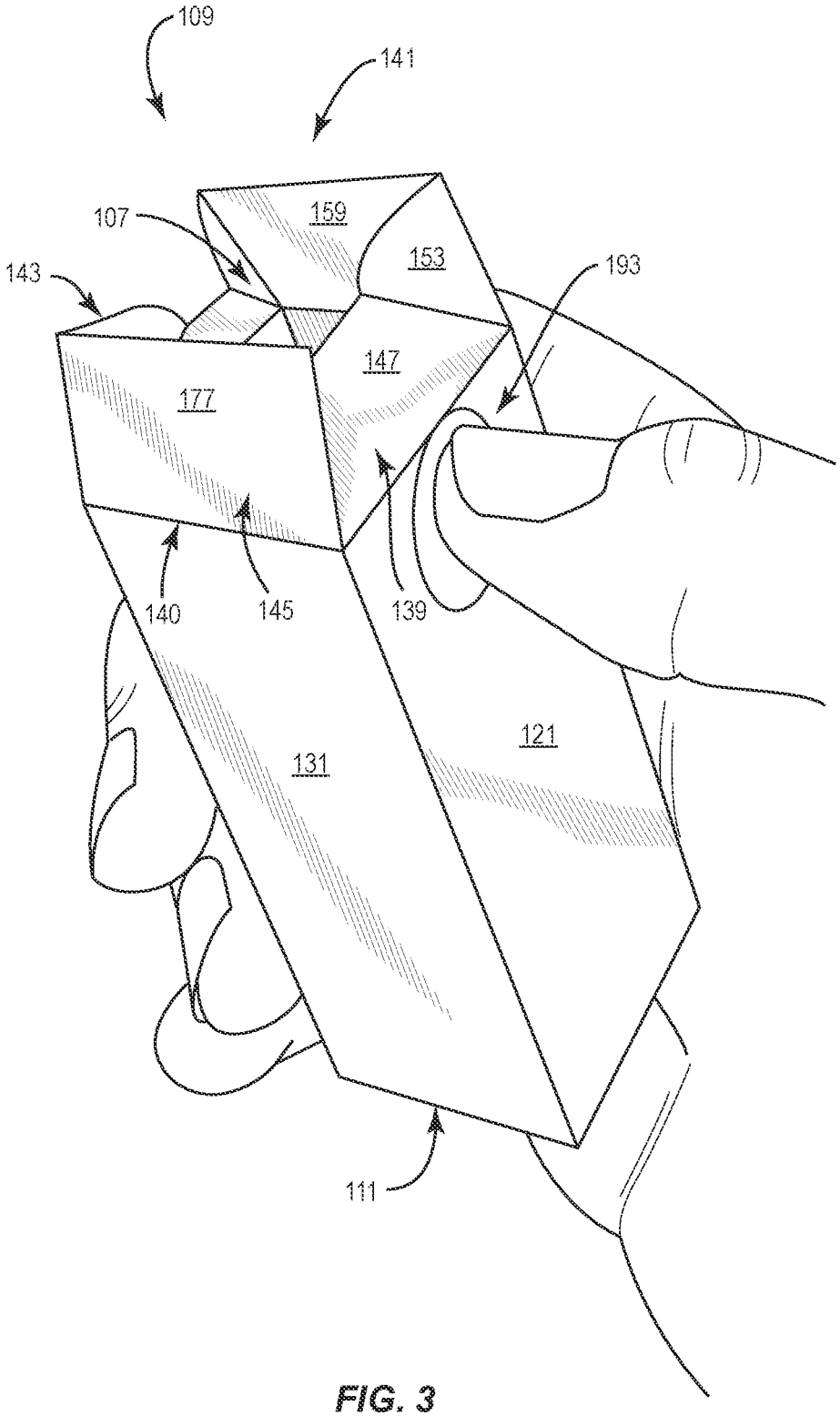
FIG. 3 is a perspective view of the carton of FIG. 2 in an open configuration according to an exemplary embodiment of the disclosure.

Turning to FIG. 3, when it is desired to transition the carton 105 from the closed configuration illustrated in FIG. 2 to an open configuration, a user can tear the distal portion 179 of the top end flap 145 from the base portion 177 of the top end flap 145, e.g., so as to provide evidence of opening, tamper, etc.

Thereafter, the user can press on one or both of user engagement regions 193, 195 positioned along respective portions of the side panels 123, 131 to at least partially compress the side panels 123, 131 toward the interior 107 of the carton 105.

Such pressing on one of the user engagement regions 193, 195 and/or compression of both user engagement regions 193, 195 can cause the end 109 of the carton 105 to transition from the closed configuration to an at least partially open configuration as illustrated in FIG. 3.

Such reconfiguration can be at least partially caused by unfurling or unfolding of the respective portions of the top end flaps 139, 143, as well as movement of the top end flaps 141, 145 away from the interior 107 of the carton 105.

In particular, the central portion 147 of the top end flap 139 can fold upwardly at the respective portion of the fold line 140 away from the interior 107 of the carton 105, with the outer portions 149, 153 of the top end flap 139 folding toward an at least partial alignment with the central portion 147 at the respective fold lines 151, 155.

Similarly, the central portion 167 of the top end flap 143 can fold upwardly at the respective portion of the fold line 140 away from the interior 107 of the carton 105, with the outer portions 169, 173 of the top end flap 143 folding toward an at least partial alignment with the central portion 167 at the respective fold lines 171, 175.

Such movement of the top end flaps 139, 143 can cause the top end flaps 141, 145 that are at least partially foldably connected thereto at respective portions of the fold lines 125, 129, 133 to fold upwardly at the respective portions of the fold line 140 and away from the interior 107 of the carton 105. Thus, in an open configuration of the carton 105, the end flaps 139, 143, 141, 145 can extend at least partially away from the interior 107 of the carton 105.

In this regard, one or more of the respective fold lines 151, 155, 171, 175, 140, 137, 129, 133 can be arranged or configured to as to urge the top end flaps 139, 141, 143, 145 toward an open configuration upon application of pressure to one or both of the user engagement regions 193, 195. Such transition of the carton 105 from the closed configuration to the open configuration can be accompanied by an audible and/or tactile pop, e.g., to provide haptive feedback to such operation of the carton 105, as well as to attract attention to the carton 105 by the user or passersby.

Figure 4:
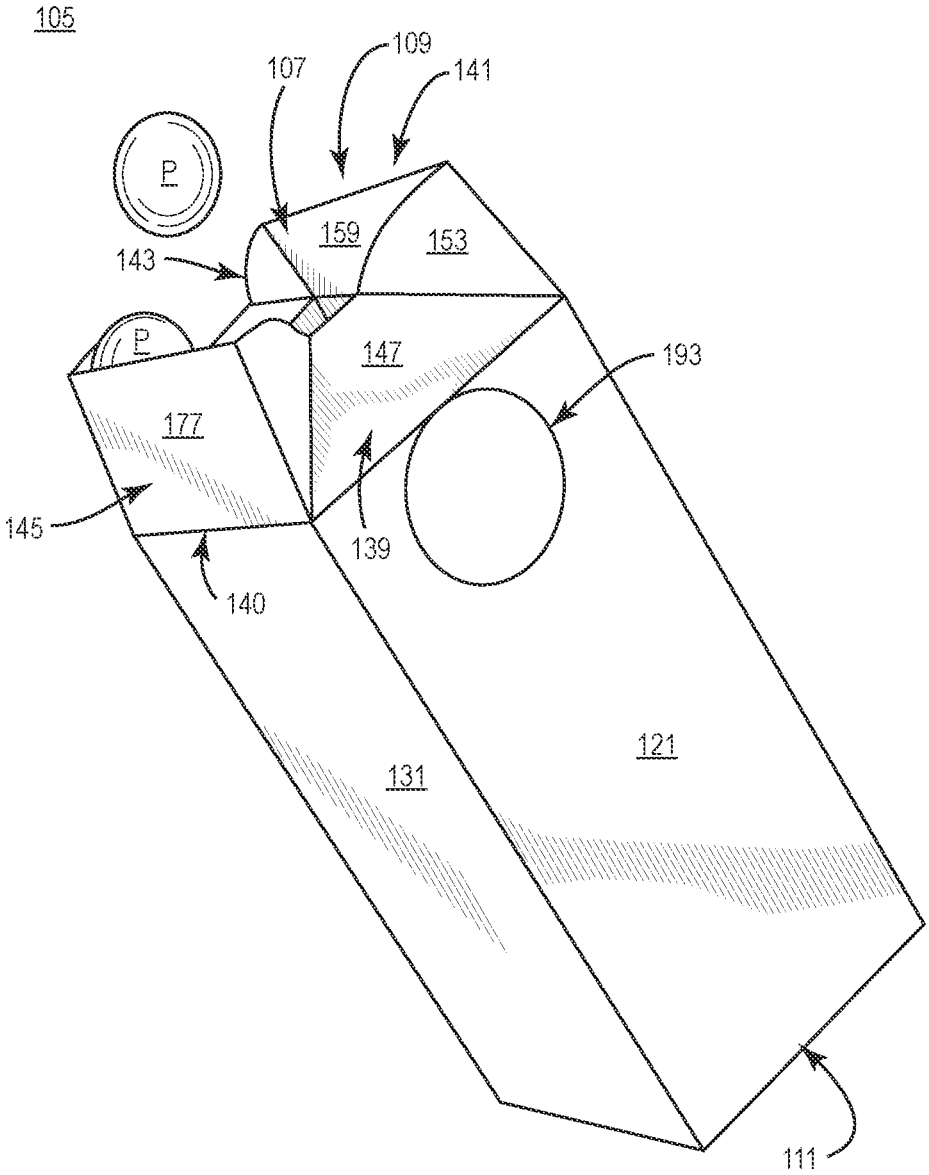
FIG. 4 is a perspective view of the carton of FIG. 2 in an open configuration and dispensing food products according to an exemplary embodiment of the disclosure.

As shown in FIG. 4, the open configuration of the carton 105 can allow a user to dispense one or more articles such as food products P from the interior 107 of the carton 105 in a generally controlled and/or metered fashion, for example, into the palm of his or her hand, the palm of another person's hand, into a serving container, etc. In some embodiments, the generally unfurled configuration of the top end flaps 139, 141 can provide dispenser features for facilitating such controlled egress of one or more food products P from the interior 107 of the carton 105.

Reconfiguration of the carton 105 from the open configuration to the closed configuration can be accomplished by repeating the steps described upon initial formation of the carton 105 with regard to the top end flaps 139, 141, 143, 145. In some embodiments, such reclosure of the top end 109 of the carton 105 can involve one or more of the top end flaps 139, 141, 143, 145 being at least partially biased toward the interior 107 of the carton 105 upon at least initial downward folding at a respective portion of the fold line 140. Such biasing can provide a snap-like sensation to a user of the carton 105.

From such a reclosed arrangement, the carton 105 can again be opened and reclosed as described above. In some embodiments, the carton 105 can include one or more securing or locking features to maintain the carton 105 in one of the open or closed configurations.

In view of the foregoing, the blank 103/carton 105 is reconfigurable between an open configuration of the carton 105, in which at least one reclosable end of the carton 105 provides access to the interior 107 of the carton 105, and a closed configuration of the carton 105, in which the at least one reclosable end of the carton 105 restricts access to the interior 107 of the carton 105.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the cartons, to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels extending at least partially around an interior of the carton, the plurality of panels comprising a plurality of side panels, the plurality of side panels comprises a first side panel, a second side panel, a third side panel, and a fourth side panel, the first side panel is positioned opposite the third side panel, the second side panel is positioned opposite the fourth side panel;

a plurality of end flaps foldably connected to a respective side panel of the plurality of side panels, the plurality of end flaps forming a reclosable end of the carton, the plurality of end flaps comprising a first top end flap having a plurality of reconfigurable portions, the first top end flap foldably connected to the first side panel, and the plurality of end flaps further comprises a second top end flap foldably connected to the third side panel, a third top end flap foldably connected to the second side panel, and a fourth top end flap foldably connected to the fourth side panel, the second top end flap comprising a plurality of reconfigurable portions, each end flap of the plurality of end flaps is foldably connected to a respective adjacent end flap of the plurality of end flaps, each of the third top end flap and the fourth top end flap comprises a respective base portion foldably connected to a respective distal portion; and opening features for transitioning the reclosable end of the carton from a closed configuration to an open configuration with haptic feedback when pressed by a user, the opening features comprise at least one user engagement region positioned along an upper portion of a respective side panel of the plurality of side panels such that the haptic feedback is in response to a force being applied to the at least one user engagement region positioned along the respective side panel.

2. The carton of claim 1, wherein the first top end flap is foldably connected to the respective side panel of the plurality of side panels at a fold line, the at least one user engagement region is positioned proximate the fold line.

3. The carton of claim 1, wherein the at least one user engagement region is a first user engagement region positioned along the first side panel, and the opening features further comprise a second user engagement region positioned along the third side panel.

4. The carton of claim 1, wherein the plurality of reconfigurable portions of the first top end flap comprises a central portion foldably connected to at least one outer portion at an oblique fold line.

5. The carton of claim 4, wherein the first top end flap is for being positioned in the interior of the carton when the reclosable end of the carton is in the closed configuration, the first top end flap is for being positioned extending away from the interior of the carton when the reclosable end of the carton is in the open configuration.

6. The carton of claim 5, wherein the at least one outer portion is a first outer portion and the plurality of reconfigurable portions of the first top end flap comprises a second outer portion foldably connected to the central portion at an oblique fold line.

7. The carton of claim 6, wherein the plurality of reconfigurable portions of the second top end flap comprises a central portion foldably connected to each of a first outer portion and a second outer portion at a respective oblique fold line.

8. The carton of claim 6, wherein the reclosable end of the carton is a reclosable top end of the carton, the plurality of end flaps further comprises a plurality of bottom end flaps foldably connected to a respective side panel of the plurality of side panels, the plurality of bottom end flaps at least partially overlapped to form a closed bottom end of the carton.

9. The carton of claim 6, wherein the first top end flap is foldably connected to the third top end flap, the third top end flap is foldably connected to the second top end flap, and the second top end flap is foldably connected to the fourth top end flap.

10. The carton of claim 6 wherein the distal portion of the fourth top end flap is separable from the base portion of the fourth top end flap, the distal portion of the fourth top end flap is for being attached to the base portion of the third top end flap when the reclosable end of the carton is in the closed configuration to provide a tamper evident feature.

11. A blank for forming a carton for holding at least one article, the blank comprising:

a plurality of panels for extending at least partially around an interior of the carton formed from the blank, the plurality of panels comprising a plurality of side panels, the plurality of side panels comprises a first side panel, a second side panel, a third side panel, and a fourth side panel, the first side panel is for being positioned opposite the third side panel when the carton is formed from the blank, the second side panel is for being positioned opposite the fourth side panel when the carton is formed from the blank;

a plurality of end flaps foldably connected to a respective side panel of the plurality of side panels, the plurality of end flaps for forming a reclosable end of the carton formed from the blank, the plurality of end flaps comprising a first top end flap having a plurality of reconfigurable portions, the first top end flap foldably connected to the first side panel, and the plurality of end flaps further comprises a second top end flap foldably connected to the third side panel, a third top end flap foldably connected to the second side panel, and a fourth top end flap foldably connected to the fourth side panel, the second top end flap comprising a plurality of reconfigurable portions, each end flap of the plurality of end flaps is foldably connected to a respective adjacent end flap of the plurality of end flaps, each of the third top end flap and the fourth top end flap comprises a respective base portion foldably connected to a respective distal portion; and opening features for transitioning the reclosable end of the carton formed from the blank from a closed configuration to an open configuration with haptic feedback when the opening features are pressed by a user, the opening features comprise at least one user engagement region positioned along an upper portion of a respective side panel of the plurality of side panels such that the haptic feedback is in response to a force being applied to the at least one user engagement region positioned along the respective side panel.

12. The blank of claim 11, wherein the first top end flap is foldably connected to the respective side panel of the plurality of side panels at a fold line, the at least one user engagement region is positioned proximate the fold line.

13. The blank of claim 11, wherein the second side panel is for being positioned opposite the fourth side panel when the carton formed from the blank, the at least one user engagement region is a first user engagement region positioned along the first side panel, and the opening features further comprise a second user engagement region positioned along the third side panel.

14. The blank of claim 11, wherein the plurality of reconfigurable portions of the first top end flap comprises a central portion foldably connected to at least one outer portion at an oblique fold line.

15. The blank of claim 14, wherein the first top end flap is for being positioned in the interior of the carton formed from the blank when the reclosable end of the carton formed from the blank is in the closed configuration, the first top end flap is for being positioned extending away from the interior of the carton formed from the blank when the reclosable end of the carton formed from the blank is in the open configuration.

16. The blank of claim 15, wherein the at least one outer portion is a first outer portion and the plurality of reconfigurable portions of the first top end flap comprises a second outer portion foldably connected to the central portion at an oblique fold line.

17. The blank of claim 16, wherein the plurality of reconfigurable portions of the second top end flap comprises a central portion foldably connected to each of a first outer portion and a second outer portion at a respective oblique fold line.

18. The blank of claim 16, wherein the plurality of end flaps further comprises a third top end flap foldably connected to the second side panel and a fourth top end flap foldably connected to the fourth side panel, each end flap of the plurality of end flaps is foldably connected to a respective adjacent end flap of the plurality of end flaps.

19. The blank of claim 18, wherein the reclosable end of the carton formed from the blank is a reclosable top end of the carton formed from the blank, the plurality of end flaps further comprises a plurality of bottom end flaps foldably connected to a respective side panel of the plurality of side panels, the plurality of bottom end flaps for being at least partially overlapped to form a closed bottom end of the carton formed from the blank.

20. The blank of claim 18, wherein the first top end flap is foldably connected to the third top end flap, the third top end flap is foldably connected to the second top end flap, and the second top end flap is foldably connected to the fourth top end flap.

21. The blank of claim 18, wherein the distal portion of the fourth top end flap is separable from the base portion of the fourth top end flap, the distal portion of the fourth top end flap is for being attached to the base portion of the third top end flap when the reclosable end of the carton formed from the blank is in the closed configuration to provide a tamper evident feature.

22. A method of forming a carton for holding at least one article, the method comprising:

obtaining a blank comprising a plurality of panels, a plurality of end flaps foldably connected to a respective panel of the plurality of panels, and opening features, the plurality of panels comprising a plurality of side panels, the plurality of side panels comprises a first side panel, a second side panel, a third side panel, and a fourth side panel, the plurality of end flaps comprising a first top end flap having a plurality of reconfigurable portions, the first top end flap foldably connected to the first side panel, and the plurality of end flaps further comprises a second top end flap foldably connected to the third side panel, a third top end flap foldably connected to the second side panel, and a fourth top end flap foldably connected to the fourth side panel, the second top end flap comprising a plurality of reconfigurable portions, each end flap of the plurality of end flaps is foldably connected to a respective adjacent end flap of the plurality of end flaps, each of the third top end flap and the fourth top end flap comprising a respective base portion foldably connected to a respective distal portion, the opening features comprise at least one user engagement region positioned along an upper portion of a respective side panel of the plurality of side panels;

positioning the plurality of panels extending at least partially around an interior of the carton comprising positioning the first side panel opposite the third side panel and positioning the second side panel opposite the fourth side panel; and forming a reclosable end of the carton from the plurality of end flaps such that the opening features are for transitioning the reclosable end of the carton from a closed configuration to an open configuration with haptic feedback when pressed by a user;

wherein the haptic feedback is in response to a force being applied to the at least one user engagement region positioned along the respective side panel.

23. The method of claim 22, further comprising pressing the at least one user engagement region to transition the reclosable end of the carton from the closed configuration to the open configuration.

24. The method of claim 22, wherein the first top end flap is foldably connected to the respective side panel of the plurality of side panels at a fold line, the at least one user engagement region is positioned proximate the fold line.

25. The method of claim 22, wherein the at least one user engagement region is a first user engagement region positioned along the first side panel, and the opening features further comprise a second user engagement region positioned along the third side panel.

26. The method of claim 22, wherein the plurality of reconfigurable portions of the first top end flap comprises a central portion foldably connected to at least one outer portion at an oblique fold line.

27. The method of claim 26, wherein the reclosable end of the carton is formed such that the first top end flap is for being positioned in the interior of the carton when the reclosable end of the carton is in the closed configuration, and first top end flap is for being positioned extending away from the interior of the carton when the reclosable end of the carton is in the open configuration.

28. The method of claim 27, wherein the at least one outer portion is a first outer portion and the plurality of reconfigurable portions of the first top end flap comprises a second outer portion foldably connected to the central portion at an oblique fold line.

29. The method of claim 28, wherein the plurality of reconfigurable portions of the second top end flap comprises a central portion foldably connected to each of a first outer portion and a second outer portion at a respective oblique fold line.

30. The method of claim 28, wherein the plurality of end flaps further comprises a third top end flap foldably connected to the second side panel and a fourth top end flap foldably connected to the fourth side panel, each end flap of the plurality of end flaps is foldably connected to a respective adjacent end flap of the plurality of end flaps.

31. The method of claim 30, wherein the reclosable end of the carton is a reclosable top end of the carton, the plurality of end flaps further comprises a plurality of bottom end flaps foldably connected to a respective side panel of the plurality of side panels, the plurality of bottom end flaps at least partially overlapped to form a closed bottom end of the carton.

32. The method of claim 30, wherein the first top end flap is foldably connected to the third top end flap, the third top end flap is foldably connected to the second top end flap, and the second top end flap is foldably connected to the fourth top end flap.

33. The method of claim 30, wherein the distal portion of the fourth top end flap is separable from the base portion of the fourth top end flap, and the reclosable end of the carton is formed such that the distal portion of the fourth top end flap is for being attached to the base portion of the third top end flap when the reclosable end of the carton is in the closed configuration to provide a tamper evident feature.

* * * * *